US009546808B2

(12) United States Patent
Klingshirn et al.

(10) Patent No.: US 9,546,808 B2
(45) Date of Patent: Jan. 17, 2017

(54) REFRIGERATION APPLIANCE

(71) Applicant: BSH BOSCH UND SIEMENS HAUSGERÄTE GmbH, München (DE)

(72) Inventors: Astrid Klingshirn, Zusmarshausen (DE); Immanuel Ring, Bopfingen (DE); Markus Spielmannleitner, Ellwangen (DE)

(73) Assignee: BSH Hausgeräte GmbH, Munich (DE)

( * ) Notice: Subject to any disclaimer, the term of this patent is extended or adjusted under 35 U.S.C. 154(b) by 273 days.

(21) Appl. No.: 14/406,323

(22) PCT Filed: Jun. 7, 2013

(86) PCT No.: PCT/EP2013/061770
§ 371 (c)(1),
(2) Date: Dec. 8, 2014

(87) PCT Pub. No.: WO2013/186128
PCT Pub. Date: Dec. 19, 2013

(65) Prior Publication Data

US 2015/0184918 A1 Jul. 2, 2015

(30) Foreign Application Priority Data

Jun. 13, 2012 (DE) ..... 10 2012 209 938

(51) Int. Cl.
*F25D 17/06* (2006.01)
*F25D 17/08* (2006.01)
*F25D 25/02* (2006.01)

(52) U.S. Cl.
CPC ..... *F25D 17/062* (2013.01); *F25D 17/067* (2013.01); *F25D 17/08* (2013.01); *F25B 2700/02* (2013.01); *F25D 25/025* (2013.01); *F25D 2317/061* (2013.01)

(58) Field of Classification Search
CPC ..... F25D 17/062; F25D 17/067; F25D 17/08; F25D 25/025; F25D 2317/061; F25B 2700/02
(Continued)

(56) References Cited

U.S. PATENT DOCUMENTS 5,458,186 A * 10/1995 Lee ..... F25D 17/065 165/263
7,891,205 B2 * 2/2011 Cushman ..... F25D 17/065 62/151
(Continued)

FOREIGN PATENT DOCUMENTS

CN 1243938 2/2000
CN 1714264 12/2005
(Continued)

OTHER PUBLICATIONS

International Search Report for PCT/EP2013/061770 mailed Sep. 16, 2013, 4 pages.
(Continued)

*Primary Examiner* — Marc Norman
(74) *Attorney, Agent, or Firm* — Nixon & Vanderhye P.C.

(57) ABSTRACT

In a refrigeration appliance, particularly a household refrigeration appliance, having a storage space for cooled material, at least one passage for the flow of air into and out of the storage space is formed in a wall delimiting the storage space. A fan drives an air flow. A moveable closure element between the fan and the storage space is arranged at the passage, which closure element in the open position allows a flow of air driven by said fan to circulate in the storage space and in the closed position guides the flow of air driven by the fan through a duct running along one outer side of a wall of the storage space.

13 Claims, 4 Drawing Sheets

(58) Field of Classification Search
USPC ..... 62/187
See application file for complete search history.

(56) References Cited

U.S. PATENT DOCUMENTS

| | | | | |
|---|---|---|---|---|
| 2002/0104325 | A1* | 8/2002 | Mandel | F25D 17/042 62/187 |
| 2003/0115892 | A1* | 6/2003 | Fu | F25D 17/042 62/187 |
| 2006/0248916 | A1* | 11/2006 | Kim | F25D 17/065 62/408 |
| 2008/0178621 | A1 | 7/2008 | Kang | |
| 2008/0196440 | A1* | 8/2008 | Kang | F25D 17/065 62/407 |
| 2010/0300137 | A1* | 12/2010 | Lim | F25D 17/065 62/419 |

FOREIGN PATENT DOCUMENTS

| | | |
|---|---|---|
| CN | 1806155 | 7/2006 |
| CN | 101963437 | 2/2011 |
| CN | 202101488 U | 1/2012 |
| EP | 1 936 302 | 6/2008 |
| JP | 3-77192 | 8/1991 |
| JP | 2000-346525 | 12/2000 |
| WO | WO 2004/038312 | 5/2004 |

OTHER PUBLICATIONS

Written Opinion of the ISA for PCT/EP2013/061770 mailed Sep. 16, 2013, 5 pages.
International Preliminary Report on Patentability for PCT/EP2013/061770 dated Sep. 1, 2014, 22 pages.

* cited by examiner

REFRIGERATION APPLIANCE

This application is the U.S. national phase of International Application No. PCT/EP2013/061770, filed 7 Jun. 2013, which designated the U.S. and claims priority to DE Patent Application No. 10 2012 209 938.7, filed 13 Jun. 2012, the entire contents of each of which are hereby incorporated by reference.

The present invention relates to a refrigeration appliance, in particular a household refrigeration appliance, which is particularly suitable for storing chilled goods that are susceptible to drying out. The shelf life of food that is not packaged in a sterile and air-tight manner in a refrigeration appliance is limited by microbial decay, chemical and enzymatic decay processes and by drying out. Fresh food such as fruit, vegetables, salads or fresh herbs give off moisture—in addition to the humidity released by natural respiration—to their environment until equilibrium is reached between them and the ambient air. The associated drying out of such foods is generally irreversible and results in said food being judged to be no longer fit for consumption long before consumption is actually questionable in respect of health due to possible colonization by micro-organisms. In order to be able to store fresh food for a long time in a refrigeration appliance while still maintaining its quality, it is therefore desirable to minimize evaporation. Storage with too high a level of air humidity must also be avoided, as this in turn would promote the growth of micro-organisms to a significant degree.

A refrigeration appliance according to the preamble of claim 1 is known from DE 101 61 306 A1. With this no-frost refrigeration appliance a user is able to operate a fan, which circulates air between a storage space and an evaporator chamber, and a compressor, which supplies the evaporator with liquid refrigerant, at different times. If said user observes condensation in the storage space, he/she can prevent moisture being transported back from the evaporator into the storage space by keeping the evaporator at a low temperature even when the fan is not operating. Conversely, if said user ascertains that chilled goods are drying out excessively in the storage space, he/she can leave the fan running while the evaporator is not cooling, in order thus to evaporate air humidity deposited on the evaporator once again and convey it back into the storage space. The effectiveness of this approach is limited in that in practice the rate at which moisture is released in the storage space varies with the nature and quantity of the chilled goods accommodated therein and it is therefore almost impossible for a user to find a setting that guarantees a good storage climate all the time. Instead the problem arises that a high level of air humidity that is desirable per se increases the risk of condensed water being deposited at a particularly cool point in the storage space. Also the constant switching between on and off phases of the compressor and fan results in fluctuations in the air humidity in the storage space, with minimum air humidity values always occurring at the end of a common compressor and fan operating phase. The moisture previously present in the air of the storage space is firmly bound at the evaporator until said evaporator heats up—generally not until the end of a non-operating phase. The moisture required to restore the equilibrium between the air of the storage space and the food stored therein is therefore primarily given off by the food, resulting in premature decay.

The object of the invention is to create a refrigeration appliance which can offer improved storage conditions for fresh moisture-emitting chilled goods.

The object is achieved in that in a refrigeration appliance, in particular a household refrigeration appliance, with a storage space for perishable chilled goods, which has at least one passage for the flow of air into and/or out of the storage space in a wall delimiting the storage space, and a fan for driving an air flow, a movable closure element is arranged at the passage between the fan and the storage space, allowing an air flow driven by the fan to circulate in the open position and guiding the air flow driven by the fan by way of a duct running along an outer face of a wall of the storage space in the closed position. The closure element allows the temperature of the storage chamber to be set as required by an exchange of air or by an exchange of heat with the air circulating in the duct, it being possible also to exchange moisture between the storage chamber and the environment in the former instance while the exchange of moisture is prevented in the latter instance.

So that the air circulation driven by the fan in the storage space does not in turn promote the drying out of the chilled goods, the speed of the air flow in the storage space should not exceed 2 msec anywhere when the closure element is open. This can be achieved by appropriate arrangement and dimensioning of the fan; it may be even more expedient if the passage throttles the air flow in the interior of the storage space to maximum 2 m/s, while much higher flow speeds can be allowed in the duct when the passage is closed.

A control unit should be set up to control the closure element based on the air humidity present in the storage space, in order to allow the emission of moist air from the storage space by opening the closure element, if this is necessary to prevent condensed water forming in the storage space.

The control unit should therefore expediently be set up in such a manner as to open the passage when the air humidity exceeds a limit value at at least one measuring point in the storage space.

The fan can also expediently be controlled based on the air humidity in the storage space or based on the temperature there. In particular the control unit can be set up to bring the fan into operation when the difference between the air humidity and/or the temperature at two measuring points in the storage space exceeds a limit value. The mixture of air in the storage space resulting from fan operation when the closure element is open leads to the difference being reduced, regardless of whether or not the circulating air outside the storage space is further cooled and/or has more moisture removed from it at the same time.

The path of the air flow driven by the fan can pass by way of an evaporator to allow the circulating air to be cooled and/or have moisture removed from it at the evaporator, if this has been cooled during operation of the fan.

Alternatively a second fan can be provided to drive a second air flow on a path passing by way of an evaporator. Because the paths of the two air flows cross one another, air cooled at the evaporator can also enter the first air flow and cool the storage space.

According to one preferred embodiment the storage space is a container, which is arranged in a storage compartment of the refrigeration appliance.

In order to be able to handle chilled goods in a convenient manner in the container, it is expedient if the container has at least one lower and one upper container part and the lower container part can be moved without the upper container part, in particular can be removed from the storage compartment.

Components, which have to be connected to energy supply or signal lines for their operation, for example the closure element, the fan or a sensor, are preferably provided on the upper container part. They do not then impede the movement of the lower container part. The fan can also be located on a wall of the storage compartment enclosing the container.

If an evaporator, which cools the storage compartment, is provided with a defrosting heater, the control unit can be set up to keep the passage of the container closed, while the defrosting heater is in operation, thus preventing the entry of relatively warm moist air into the interior of the container during defrosting.

In order to minimize temperature fluctuations and their associated fluctuations in relative air humidity in the storage space, the wall of the storage space can be provided with an insulating heat storage medium on at least part of its surface. In order to be able to store a large quantity of heat in a small quantity of the heat storage medium, the heat storage medium is expediently selected in such a manner that a phase transition temperature of the heat storage medium corresponds to the operating temperature of the refrigeration reservoir. The heat storage medium is preferably arranged on the part of the wall of the storage space that also delimits the duct.

A further measure that can be used to minimize temperature gradients and fluctuations in the storage space is for the wall of the storage space to comprise an outer wall, an inner wall and an insulating gap in between at least on part of its surface.

Further features and advantages of the invention will emerge from the description which follows of exemplary embodiments with reference to the accompanying figures. Features of the exemplary embodiments that are not mentioned in the claims will also emerge from this description and the figures. Such features can also occur in combinations other than those disclosed specifically here. The fact that a number of such features are mentioned together in the same sentence or some other textual context therefore does not justify the conclusion that they can only occur in the specifically disclosed combination; rather it should in principle be assumed that of a number of such features some can be omitted or modified, as long as this does not call into question the functionality of the invention.

Figure 1:
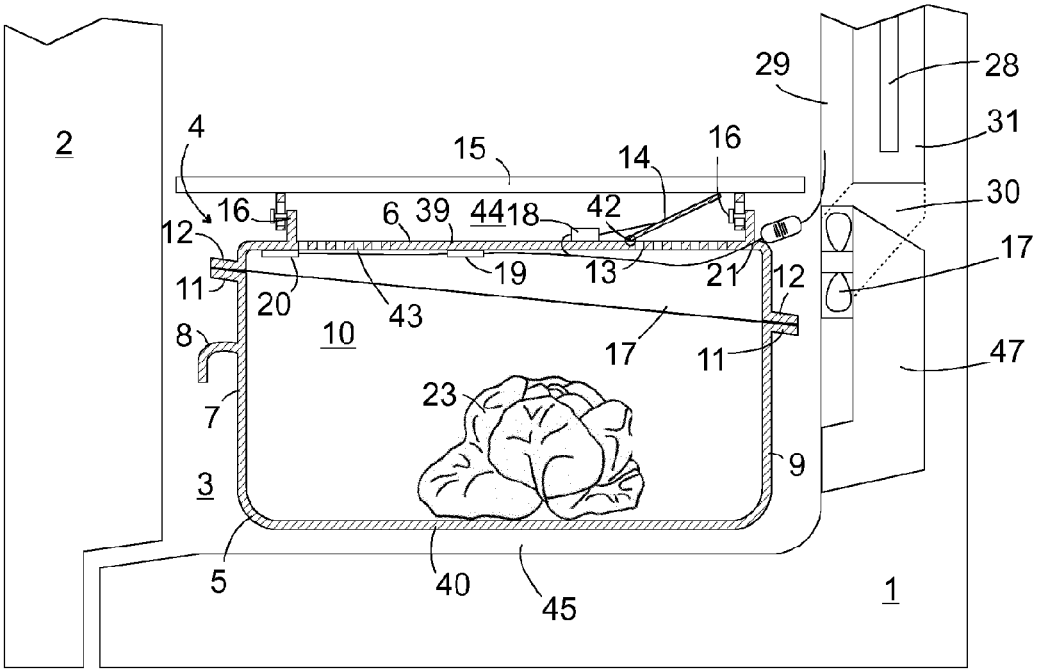
FIG. 1 shows a schematic section through a household refrigeration appliance according to a first embodiment of the invention.

FIG. 1 shows a schematic section through a household refrigeration appliance with a carcass 1 and a door 2, which enclose a chilled storage compartment 3, in particular a zero degree or fresh food chiller compartment. Further storage compartments that may be closed using a different door from the illustrated door 2, for example a standard chiller compartment and a freezer compartment, may be present.

A container 4 injection molded for example from plastic and accommodated in the storage compartment 3 comprises a lower container part 5 and an upper container part 6. The lower container part 5 is positioned on the base of the storage compartment 3 in such a manner that it can be moved in a depthwise direction. In order to keep open a duct 45 below a base 40 of the container part 5, as shown in the figure, ribs oriented in the depthwise direction of the storage compartment 3 can project upward from the base 40 of the storage compartment 3 or downward from the base 40 of the container part 5.

The lower container part 5 comprises a front wall 7 facing the door 2 with a handle 8 molded on to facilitate handling, a rear wall 9, which is less high than the front wall 7, and side walls 10, the upper edges of which drop continuously from the front wall 7 to the rear wall 9. Formed along the upper edge of the walls 7, 9, 10 is a sealing flange 11 that drops at an angle to the rear. A complementary sealing flange 12 of the upper container part 6 rests on the sealing flange 11. The contact between the flanges 11, 12 does not have to be hermetically sealed but any gap between them should be so narrow that the air circulation through such a gap is small compared with that through a passage 13 formed in the upper container part 6, when it is not closed by a closure element arranged thereon, in this instance a plate 14 that can be pivoted about an axis 42 oriented perpendicular to the sectional plane of the figure. FIG. 1 shows the plate 14 in its open position; in its closed position it rests on the passage 13 of the upper container part 6.

The upper container part 6 is suspended from a ceiling 15 of the storage compartment 3 with vertical play, e.g. with the aid of hooks 16 engaging in extended holes, to allow close contact between the sealing flanges 11, 12 even if the container parts 5, 6 are not positioned precisely above and below one another. A total of four hooks 16 are provided at four corners of the upper container part 6, which is essentially rectangular when viewed from above, two of them, a front one and a rear one, being shown in cross section in FIG. 1. An intermediate space is kept free between the two rear hooks 16, allowing the passage of an air flow driven by a fan 17. When the plate 14 is in the open position, it directs the air flow from the fan 17 into the container 4. The air flow exits again on the container 4 by way of a second passage 43, which is provided here in the upper container 6 adjacent to its front edge. When the plate 14 rests flat on the upper container part 6 in the closed position, the air flow passes through a duct 44, which is delimited by the ceiling 15 of the storage compartment 3 and a ceiling 39 of the upper compartment part 6, flows down between the front wall 7 and the door 2 and back through the duct 45 to a rear wall 29 of the carcass 1 and the fan 17 arranged there.

Fitted on the upper container part 6 are a control element 18 engaging with the plate 14, an air humidity sensor 19 and in some instances also a temperature sensor 20. A line cluster 21 connects the control element 18 and the sensors 19, 20 to an electronic control unit (not shown here) of the refrigeration appliance which uses measurement data from the sensors 19, 20 to control the fan 17, the control element 18 and, in the conventional manner, a compressor (not shown here) of the refrigeration appliance and, if it is a no-frost refrigeration appliance, a second fan for circulating air between an evaporator 28 and the storage compartment 3.

The fan 17 and control element 18 can be controlled by the control unit in different ways. In the simplest instance the fan 17 operates continuously to maintain an air flow circulating around the container 4 in the ducts 44, 45 when the plate 14 is in the closed position. When the air flow exchanges heat with the interior of the container 4 through the latter's walls, it reduces any temperature and air humidity gradients within the container 4, so that the air humidity value detected by the air humidity sensor 19 locally at its installation point is representative of the entire volume of the container 4. If this value exceeds an upper limit of for example 85%+ϵ rH, where ϵ is a small positive value, e.g. 0.5%, the control unit prompts the control element 18 to open the passage 13. The air flow is thus directed into the container 4 and moist air in the container 4 is replaced by drier air flowing in from outside. The air humidity in the container 4 is thus lowered sufficiently to prevent condensation being deposited within the container 4. When the value measured by the sensor 19 drops to 85%−ϵ, the control element 18 is again prompted to close the passage 13. The air humidity in the container 4 therefore varies within a very narrow range of 2ϵ and the quantity of moisture given off by the chilled goods 23 stored in the container 4 to maintain air humidity equilibrium is very small.

The limit value for air humidity can of course also be set at values other than the abovementioned 85% rH. The limit value should always be at least as high as the equilibrium air humidity of the chilled goods 23 but should also be far enough below 100% rH to be able to exclude the formation of condensation in relatively cool regions of the container 4 that may be shielded by chilled goods 23 from the air flow of the fan 17 directed into the container 4.

Figure 3:
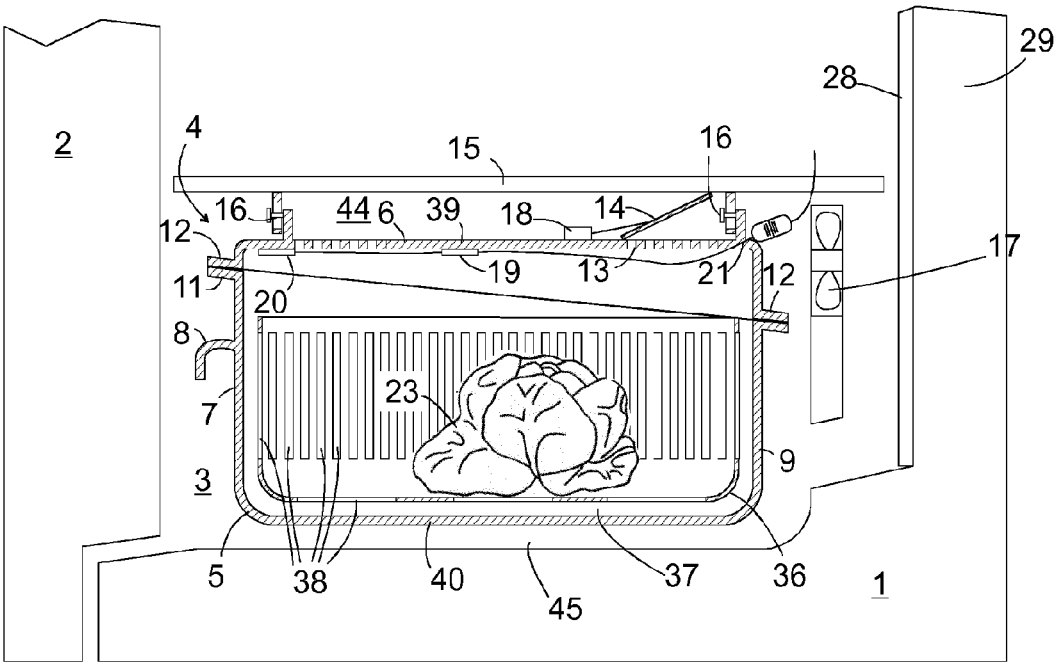
FIG. 3 shows a section according to a third embodiment of the invention.

In order to minimize the probability of such shielded regions occurring, a tray 36 can be arranged in the container 4, as shown in FIG. 3, at a distance from its walls and base, so that the air deflected into the container 4 by the plate 14 in the open position can circulate in an intermediate space 37 between lower container part 5 and tray 36, pass through openings 38 in the tray 36 and thus reach the chilled goods 23 from all sides.

According to one development the fan 17 is not operated continuously but according to need. Need-based operation of the fan 17 results when there is a clear temperature or air humidity gradient in the container 4. The existence of a temperature gradient can be concluded for example if the value measured by the temperature sensor 20 differs significantly from that of a temperature sensor (not shown in the figure), which is positioned in the manner known per se on a wall of the storage compartment 3 and serves to control compressor operation.

A temperature or air humidity gradient can of course also be measured directly in the container, if it has at least two sensors of the same type at different points. As on the one hand cold air tends to collect at the base of the container 4 and on the other hand the container 4 is primarily exposed to a heat inflow on its front face, while being cooled from the rear, whether by a cold wall evaporator or by cold air supplied by a no-frost evaporator in a duct in the rear wall 29, a temperature or humidity gradient is most likely to form between a relatively cold or moist region in proximity to the base or rear wall of the container 4 and a relatively warm or dry region in a front upper corner of the container 4. A second sensor should therefore be at a vertical and/or depthwise distance from the sensors 19, 20 and should preferably be arranged on the lower container part 5, in particular on its rear wall 9. If such a sensor is permanently fitted on the lower container part 5 and this latter is to be able to be removed from the refrigeration appliance so that the chilled goods 23 can be handled, the problem arises of transmitting the signals from such a sensor to the control unit. In the embodiment shown in FIG. 2 this problem is resolved in that a large opening 24 is formed in the rear wall 9 of the—otherwise identical to the one in FIG. 1—lower container part 5, around which, when the container part 5 is not partially pulled out, as shown in the figure, but is positioned in a sealing manner below the upper container part 6, elastic bellows 25 rest in a sealing manner against the rear wall 9. Temperature and/or air humidity sensors 26, 27 fitted in these bellows 25 are fixed in relation to the carcass 1 and connected by way of fixed lines to the control unit but are exposed to the air in the container 4 when the door 2 is closed and the container parts 5, 6 are positioned one on top of the other in a sealing manner.

Figure 2:
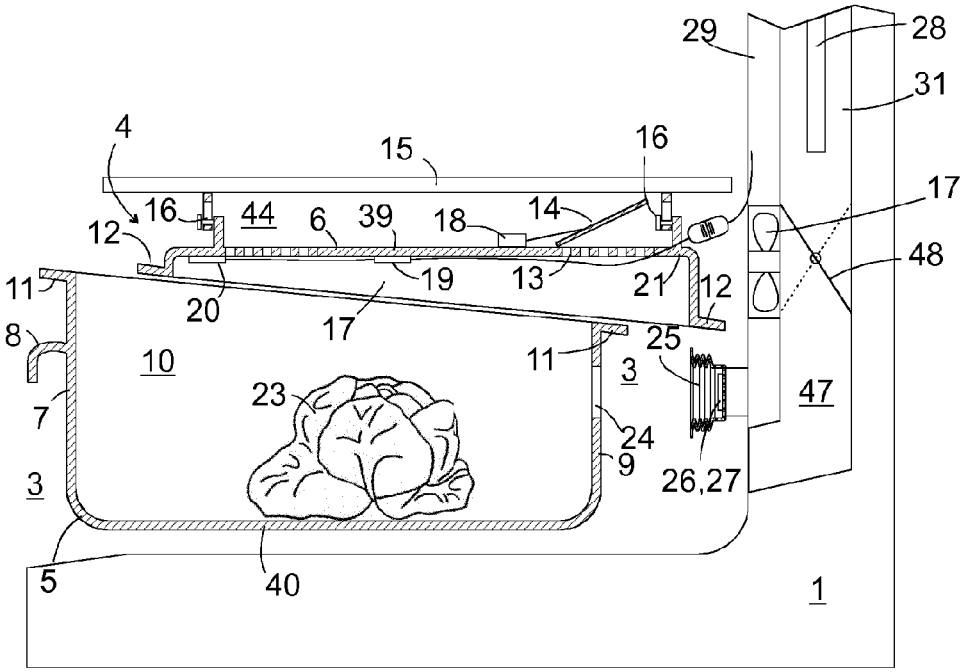
FIG. 2 shows a section through a household refrigeration appliance according to a second embodiment with the door open and the lower container part partially pulled out.
Figure 4:
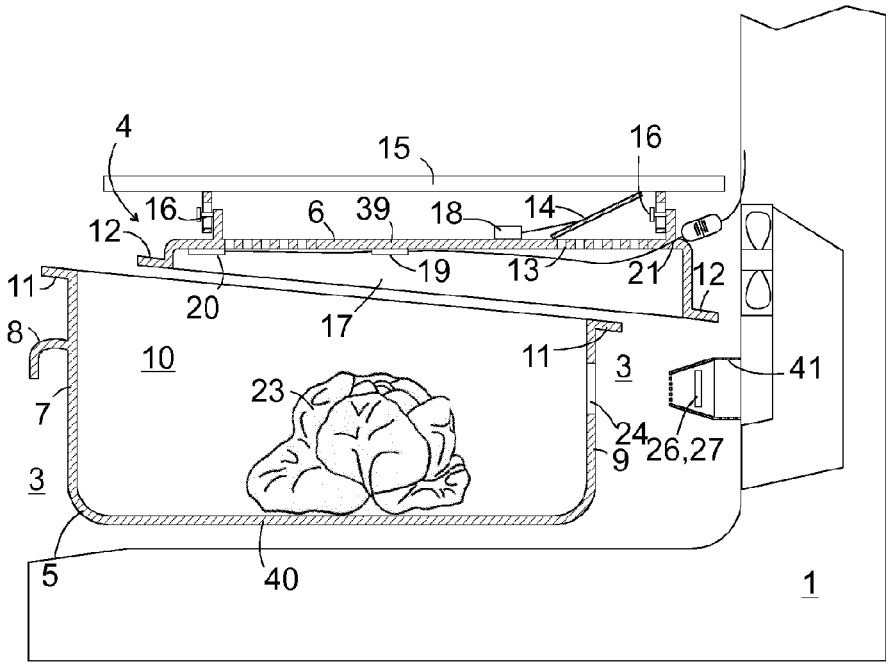
FIG. 4 shows a section according to a fourth embodiment of the invention.

As an alternative to the diagram in FIG. 2 the sensors 26, 27 can also be accommodated in a housing 41 fixed in the storage compartment 3, for example projecting from its rear wall, said housing 41 engaging in the opening 24 in the rear wall 9 when the container part 5 is pushed into the storage compartment 3. This housing 41 can taper toward the front, as shown in FIG. 4, so that it can be inserted easily and reliably into the opening 24 and a stop position, up to which the container 4 can be pushed into the storage compartment 3 and in which the opening 24 is essentially sealed by the housing 41, is defined by contact between the housing 41 and the edges of the opening 24. The tip of the housing 41 that engages in the container 4 in the stop position is opened up to allow an exchange of air between the interior of the container 4 and the sensors 26, 27 accommodated in the housing 41.

Figure 5:
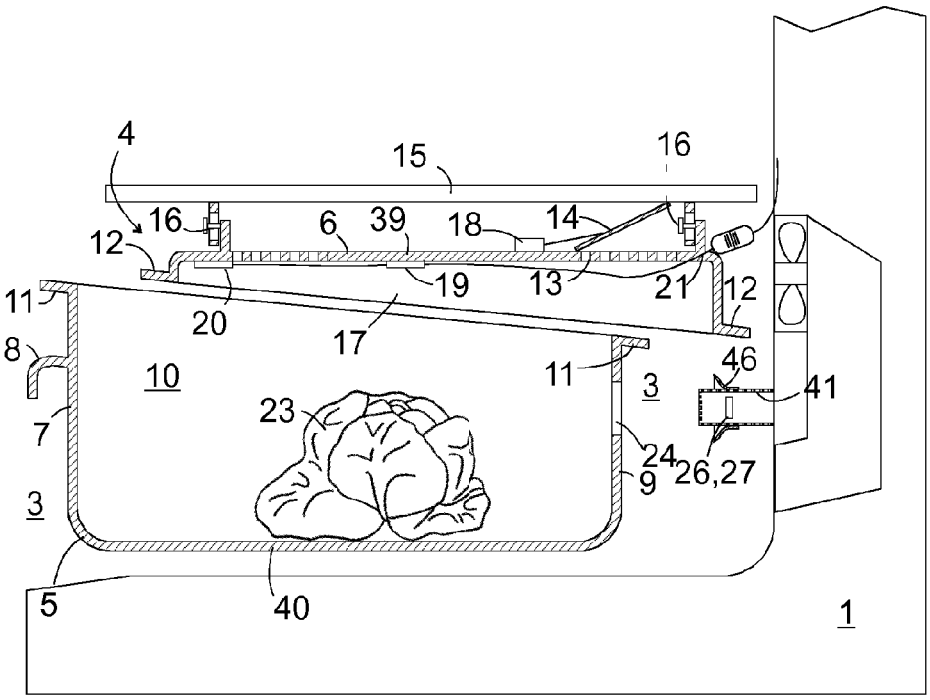
FIG. 5 shows a section according to a fifth embodiment.

According to a further alternative shown in FIG. 5 the housing 41 can be provided with a circumferential flexible skirt 46, made of rubber for example, which like the bellows 25 in FIG. 2 rests closely against the rear wall 9 in the pushed in position and seals the opening 24 even if the housing 41 itself does not touch the edges of the opening 24.

The presence of sensors 19, 20, 26, 27 for temperature and air humidity some distance away from one another in the direction of the temperature or humidity gradient allows for example the fan 17 and control element 18 to be controlled in such a manner that the fan 17 is always switched on when the difference between the air humidity values measured by the air humidity sensors 19, 27 exceeds a limit value of for example 4% rH or the difference between the values measured by the temperature sensors 20, 26 exceeds a limit value of 0.3 K and the fan 17 is switched off again as soon as the values drop below both limit values and the control element 18 opens the passage 13 when at least one of the air humidity sensors 19, 27 reports a rise in the air humidity to above 85% rH+ϵ and the passage 13 is closed again when both air humidity sensors 19, 27 report less than 85% rH−ϵ.

There are various options for positioning an evaporator 28 in the refrigeration appliance, which are shown respectively in the figures in conjunction with a specific embodiment of the container 4 but which can in principle be combined with any of said embodiments. FIG. 1 therefore shows a no-frost evaporator 28, which is accommodated in a chamber 31 that is separate from the storage compartment 3, in this instance within the rear wall 29 of the carcass 1. A passage 30, by way of which cold air that may be driven by a second fan (not shown in the figure) and is cooled at the evaporator 28 flows into the storage compartment 3, opens outside the sectional plane shown in the figure, offset laterally in relation to the fan 17, into the storage compartment 3 at roughly the latter's level.

The second fan therefore drives an air flow on a path that leads from the chamber 31 of the evaporator 28 by way of the passage 30 into the storage compartment 3 and from there by way of a passage (not shown) back into the chamber 31.

With this embodiment provision can be made for the control unit always to close the passage 13 when the second fan is in operation, in order thus to prevent very cold, dry air entering the container 4 and drying out its contents. In other words when the second fan is in operation, the air flow driven by it in the storage compartment 3 runs by way of the ducts 44, 45 but not through the container 4 itself.

With the embodiment in FIG. 2 the chamber 31 accommodating the evaporator 28 is merged with a duct 47 let into the rear wall 29 and a valve arranged downstream of the fan 17, in this instance a butterfly valve 48, can be pivoted between a position shown with a continuous line, in which it blocks the chamber 31 and allows an air flow around the container 4 by way of the duct 47, and a position shown with a broken line, in which it blocks the duct 47 and allows cold air to flow out of the chamber 31 into the storage compartment 3. Depending on the position of the butterfly valve 48 the fan 17 therefore drives the air circulation in the storage compartment 3 or the exchange of air between the storage compartment 3 and the chamber 31. The positions of the plate 14 and the butterfly valve 48 can be linked to one another here so that the passage 13 is always closed when the butterfly valve 48 is in the position shown with a broken line.

FIG. 3 shows the evaporator 28 in the form of a cold wall evaporator, upstream of which the fan 17 is arranged. When the compressor is in operation and the evaporator 28 is therefore cooled, the fan 17 can intensify the cooling of the storage compartment 3, in that it drives an air flow over the surface of the evaporator 28 extending into the storage compartment 3. During this time the passage 13 should be closed. If this results in the temporary exceeding of the air humidity limit value in the container 4 or even in small quantities of moisture condensing out on the inner faces of the container 4, it can be tolerated with relatively few problems in this embodiment, as the tray 36 prevents the chilled goods 23 coming into direct contact with the condensate.

The evaporator 28 of a no-frost refrigeration appliance as shown in FIG. 1 or 2 is generally provided with a defrosting heater to thaw frost deposited on the evaporator 28 during operation and to allow the condensation to flow away. When a defrosting operation has taken place, the compressor must run for a while before the evaporator chamber 31 cool enough for all the condensation residues remaining there to have frozen again. If the fan of the evaporator chamber 31 runs during this time, the moisture in the air passing out of the evaporator chamber 31 into the storage compartment 3 can exceed the limit value for the air in the container 4, which would result in the opening of the passage 13. In such conditions an open passage 13 would result not in a reduction but in an increase in air humidity in the container 4. Therefore in such a situation the monitoring of the air humidity in the container 4 is preferably suspended and the passage 13 remains closed regardless of the air humidity value in the container 4 until the evaporator chamber 31 has cooled down again.

Figure 6:
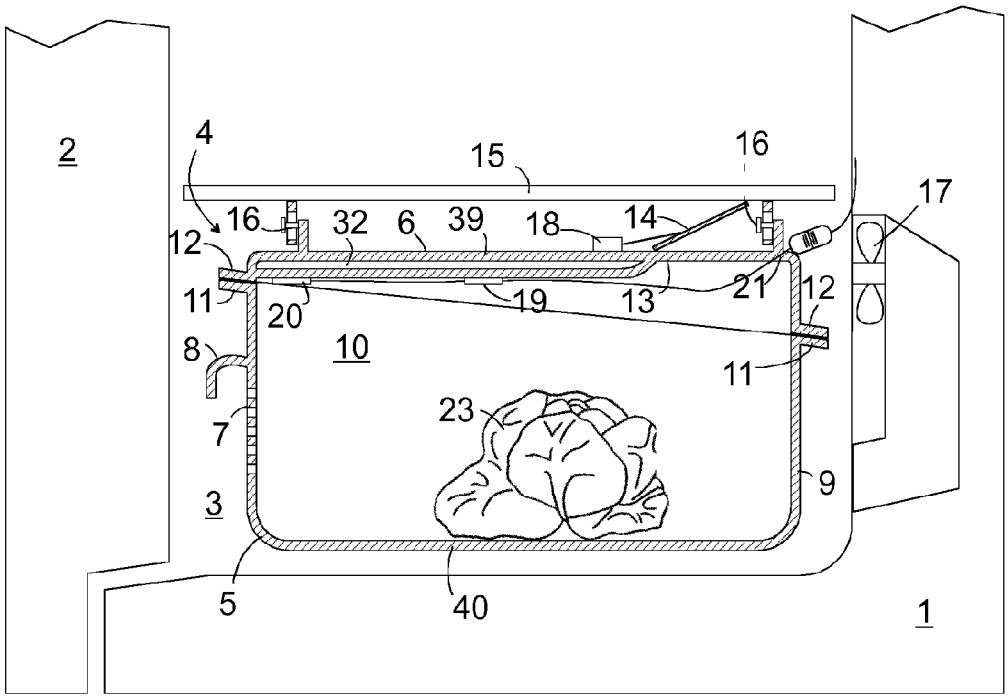
FIG. 6 shows a section according to a sixth embodiment.

If, as with the evaporator arrangements in FIGS. 1 to 3, an air flow cooled at the evaporator 28 is blown by a fan over a surface of the container 4, the resulting large temperature difference between the air flow and the air in the interior of the container 4 can cause significant local cooling in the container 4 and therefore the formation of condensed water. If there is no air humidity sensor 19 and/or 27 arranged directly in the significantly cooled region, it may happen that any exceeding of the air humidity limit value in the container 4 is nevertheless not detected. To avoid this problem, the container 4 can be embodied locally as double-walled, as shown in FIG. 6. In FIG. 6 a double-walled region is formed on the ceiling 39 of the upper container part 6; similarly however any part of the container 4 exposed to a significant flow of cold air can be embodied as double-walled. In the embodiment in FIG. 6 an intermediate space 32 in the double-walled region is filled with air, thereby forming an insulating layer, which slows down the exchange of heat between the interior of the container 4 and the air flow circulating outside. Alternatively the intermediate space 32 could also be filled with a heat-carrying fluid, which cools down when in thermal contact with the cold air circulating outside, in some instances even undergoing a phase transition and again absorbing the heat emitted in the process from the container 4 after some time has elapsed.

Figure 7:
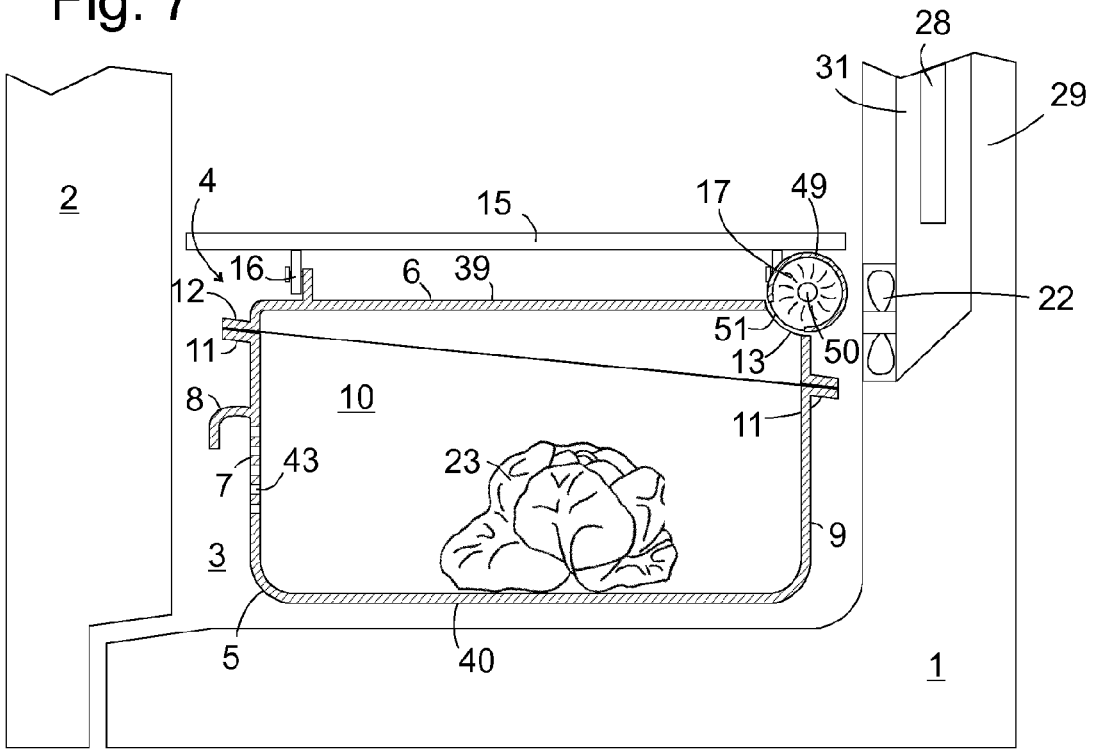
FIG. 7 shows a section according to a seventh embodiment of the invention.

FIG. 7 shows an embodiment of the refrigeration appliance in which the fan 17 is not configured as an axial rotor as in the embodiments considered above but as a radial rotor. In the known manner said fan 17 has an extended cylindrical shape and is enclosed by a housing 49, which has an intake opening 50 on at least one end face and an outlet opening 51 on a circumferential surface. The housing 49 can be rotated about the rotation axis of the fan 17 between a position as shown in FIG. 7 in which it overlaps with a passage 13 in the upper container part 6 and a position in which it blows air into the duct 44 extending between the ceiling 15 of the storage compartment 3 and the upper container part 6.

Formed in the rear wall 29 of the carcass 1, as in FIG. 1, 2, is a chamber 31 which accommodates the evaporator 28, and a second fan, which drives the exchange of air between the evaporator chamber 31 and the storage compartment 3 is shown as 22. The housing 49 prevents the air flow driven by the fan 22 passing between the ceiling 15 and the upper container part 6, forcing it onto a path leading around the lower container part 5.

LIST OF REFERENCE CHARACTERS

1 Carcass
2 Door
3 Storage compartment
4 Container
5 Lower container part
6 Upper container part
7 Front wall
8 Handle
9 Rear wall
10 Side wall
11 Flange
12 Flange
13 Passage
14 Plate
15 Ceiling
16 Hook
17 Fan
18 Control element
19 Air humidity sensor
20 Temperature sensor
21 Line cluster
22 Fan
23 Chilled goods
24 Opening
25 Bellows
26 Temperature sensor
27 Air humidity sensor
28 Evaporator
29 Rear wall
30 Passage
31 Chamber
32 Intermediate space

36 Tray
37 Intermediate space
38 Opening
39 Ceiling
40 Base
41 Housing
42 Axis
43 Passage
44 Duct
45 Duct
46 Skirt
47 Duct
48 Butterfly valve
49 Housing
50 Intake opening
51 Outflow opening

The invention claimed is:

1. A refrigeration appliance, in particular a household refrigeration appliance, with a container for chilled goods, said container being arranged in a storage compartment of the refrigerator, and a fan for driving an air flow, with a movable closure element arranged at a passage between the fan and the container, allowing an air flow driven by the fan to circulate in the container in the open position and guiding the air flow driven by the fan by way of a duct running along an outer face of a wall of the container in the closed position, characterized in that the passage for the flow of air into and/or out of the container is formed in a wall of the container.

2. The refrigeration appliance as claimed in claim 1, wherein the speed of the air flow in the container is not above 2 m/s.

3. The refrigeration appliance as claimed in claim 1, wherein a control unit is set up to control the closure element based on the air humidity present in the container.

4. The refrigeration appliance as claimed in claim 3, wherein the control unit is set up to open the passage when the air humidity exceeds a limit value at at least one measuring point in the container.

5. The refrigeration appliance as claimed in claim 1, wherein a control unit is set up to control the fan based on the air humidity and/or temperature present in the container.

6. The refrigeration appliance as claimed in claim 5, wherein the control unit is set up to bring the fan into operation when the difference between the air humidity and/or the temperature at two measuring points in the container exceeds a limit value.

7. The refrigeration appliance as claimed in claim 1, wherein the air flow driven by the fan is guided by way of an evaporator.

8. The refrigeration appliance as claimed in claim 1, wherein a second fan drives a second air flow on a path passing by way of an evaporator and the paths of the two air flows cross one another.

9. The refrigeration appliance as claimed in claim 1, wherein the container comprises at least one upper and one lower container part and the lower container part can be removed from the storage compartment without the upper container part.

10. The refrigeration appliance as claimed in claim 9, wherein the passage and the closure element are arranged on the upper container part.

11. The refrigeration appliance as claimed in claim 1, wherein an air humidity or thawing sensor is arranged on the upper container part.

12. The refrigeration appliance as claimed in claim 1, wherein the wall has a heat storage medium on at least part of its surface.

13. The refrigeration appliance as claimed in claim 1, wherein the wall comprises an outer wall, an inner wall and an intermediate space between outer and inner walls on at least part of its surface.

* * * * *